US005797463A

United States Patent [19]

Winter et al.

[11] Patent Number: 5,797,463

[45] Date of Patent: Aug. 25, 1998

[54] PNEUMATIC HAMMER

[76] Inventors: Udo Winter, Losensteinerstrasse 23, A-4020 Linz, Austria; Johann Schabelreiter, Kirchdorf 37, Pernegg, Austria; Werner Martin, Simchengasse2, A-8020 Graz, Austria

[21] Appl. No.: 513,827

[22] PCT Filed: Mar. 8, 1994

[86] PCT No.: PCT/AT94/00023

§ 371 Date: Aug. 28, 1995

§ 102(e) Date: Aug. 28, 1995

[87] PCT Pub. No.: WO94/20267

PCT Pub. Date: Sep. 15, 1994

[30] Foreign Application Priority Data

Mar. 8, 1993 [AU] Australia ..... A-441/93

[51] Int. Cl.[6] ..... B25D 17/24

[52] U.S. Cl. ..... 173/211; 173/15; 173/162.1

[58] Field of Search ..... 173/210, 211, 173/162.1, 162.2, 218, 15, 17, 128, 169, 114, 133, 135

[56] References Cited

U.S. PATENT DOCUMENTS

| | | | |
|---|---|---|---|
| 2,341,497 | 2/1944 | Amtsberg | 173/210 |
| 2,949,909 | 8/1960 | Macchioni et al. | 173/211 |
| 3,053,231 | 9/1962 | Fairchild | 173/211 |
| 3,063,508 | 11/1962 | Henry | 173/211 |
| 3,375,881 | 4/1968 | Myers et al. | 173/210 |
| 4,072,199 | 2/1978 | Wanner | 173/211 |
| 4,102,410 | 7/1978 | Ross | 173/210 |
| 4,614,241 | 9/1986 | Crover | 173/211 |
| 5,485,887 | 1/1996 | Mandanis | 173/211 |

FOREIGN PATENT DOCUMENTS

| | | |
|---|---|---|
| 522344 | 1/1993 | European Pat. Off. . |
| 529405 | 3/1993 | European Pat. Off. . |
| 1 018 819 | 11/1957 | Germany . |
| 1 587 611 | 4/1981 | United Kingdom . |

*Primary Examiner*—Scott A. Smith
*Attorney, Agent, or Firm*—Collard & Roe, P.C.

[57] ABSTRACT

A pneumatic hammer comprises a rigid unit of construction, which comprises a housing, a handle, an operating cylinder resiliently supported in the housing, and a tool holder for receiving a tool movable in a striking direction by the operating cylinder. The operating cylinder is axially movable in the housing relative to the tool holder. Compressed air is supplied to the operating cylinder, and a damping spring acts upon the tool holder in a direction opposite to the striking direction.

5 Claims, 2 Drawing Sheets

PNEUMATIC HAMMER

BACKGROUND OF THE INVENTION

1. Field of the Invention

This invention relates to a pneumatic hammer comprising a housing, which is provided with a handle, an operating cylinder, which is resiliently supported within the housing, and a tool holder for receiving a tool.

In pneumatic hammers, the reversible supply of compressed air to the operating cylinder, the reciprocation of the piston in the operating cylinder, the impacts of the piston on the tool, the rebound of the tool and the like actions give rise to a generation of intense noise and strong vibration, which in the absence of countermeasures will be dangerous to health. To suppress noise, it is known to design the housing as a sound absorber. Whereas that measure in conjunction with a corresponding sound insulation of the source of compressed air will result in an appreciable alleviation of the noise, a satisfactory damping of vibration has not yet been achieved. Various spring and rubber elements have been used in pneumatic hammers for damping vibration by cushioning the operating part of the hammer relative to the handle. In most cases a plurality of damping inserts are provided in series between the tool and the handle. Such damping inserts and spring elements have a soft spring characteristic to ensure a corresponding damping action so that the operating part is movable relative to the handle. For this reason the operator of the pneumatic hammer is deprived during his work of feeling for the tool and the workpiece. This is so because as the pneumatic hammer is forced against the workpiece the handle will yield to a relatively large extent before the desired pressure is applied, and the disengagement of the tool also requires a retraction of the handle to a large extent until the tool proper has disengaged the work-piece and then follows the retraction of the handle. The inconsistent requirements for a tool which is rigid so that it can effectively be guided, on the one hand, and for an appreciable damping of vibration by a soft cushioning, on the other hand, have previously necessitated a rather unsatisfactory compromise between the ability to guide the hammer and the vibration damping.

2. Description of the Prior Art

DE-B 10 18 819 discloses, for instance, a pneumatic hammer which is of the kind described first hereinbefore and in which the tool receptacle is constituted by the operating cylinder, which is longitudinally guided in the housing, and shocks are absorbed in that the operating cylinder is resiliently clamped in the transitional region between the housing and the handle and an elastic ring for supporting a flange of a tool is provided at the lower end of the housing. Because the tool receptacle is integrated in the operating cylinder, that operating cylinder will necessarily be forced against the housing when transverse forces occur and the operating cylinder will then be seized in its longitudinal guide so that any damping action will be eliminated. Besides, because the operating cylinder is suspended adjacent to the handle, it is inherently impossible to use the housing as a means for assisting the damping of the reaction forces of the operating cylinder.

SUMMARY OF THE INVENTION

It is an object of the invention to eliminate these disadvantages and to provide a pneumatic hammer which is of the kind described first hereinbefore and is simple and robust in design, has good handling properties appropriate for the work to be performed and is also distinguished by an excellent vibration damping.

That object is accomplished by the invention in that the handle, the housing, and the tool holder constitute a rigid unit of construction, the operating cylinder is axially movably guided relative to the tool holder, and the tool holder is provided with tool-damping means, which act opposite to the striking direction. Owing to the provision of said unit of construction the operator of the pneumatic hammer perceives that the connection between the handle and the tool holder has the stiffness required for the desired guidance of the hammer and owing to the presence of that unit of construction the damping action of the housing, which serves as a sound absorber and is preferably made of plastic, can also be used to damp vibration. The vibration due to the operating cylinder is damped by the resilient support of the operating cylinder relative to the unit of construction and that resilient support will not adversely affect the stiffness of the connection between the handle and the tool holder and for this reason may have a spring characteristic which is as soft as desired. For the damping of the vibration which is due to rebound and for the reduction of the kickback forces of the tool itself the tool holder is provided with damping means of its own, which require only a rather short spring stroke and may have a correspondingly hard spring characteristic so that the feeling experienced by the hand during the work with the pneumatic hammer will not be influenced or will be influenced only to a negligeable degree by said damping means.

It will be desirable to provide a longitudinal guide for the operating cylinder, which is resiliently supported adjacent to the tool holder. In that case the operating cylinder is suspended within the unit of construction so that the cylinder can oscillate freely. This can be achieved by the use of the soft springs, which will effect the desired vibration damping. Besides, owing to the resilient cushioning adjacent to the tool holder, the damping properties of the housing,which connects the tool holder to the handle, can be utilized for an additional vibration damping.

According to a particularly desirable feature of the invention the operating cylinder is supported by transverse leaf spring, which by means of spacers are supported at one end on the operating cylinder and at the other end on the unit of construction. Leaf springs require only a small space and have a soft characteristic which is required for an effective damping. If they are arranged with a proper symmetry they will provide proper guidance for the oscillating motion of the operating cylinder. As a result, the longitudinal guide provided on the same side as the handle may consist of simple sliding guides.

If the unit of construction is held together by means of tie rods extending between the handle and the tool holder and the leaf springs for supporting the operating cylinder engage said tie rods, the unit of construction will be simple and can economically be manufactured and with a few manual operations can be assembled from the prefabricated individual parts and clamped together. Even if the housing is thin-walled the tie rods will provide for the required stiffness and a very robust structure will be obtained.

The design may be simplified further if the tie rods constitute the longitudinal guide for the operating cylinder because the tie rods as guide rods will then have to extend only through corresponding bores in a cylinder flange or the like in order to ensure the required longitudinal guidance for the operating cylinder.

Compressed air may be supplied to the operating cylinder by means of a flexible line providing a connection between means for controlling the operating cylinder and port means provided in the unit of construction. In that case a reliable supply of power to the pneumatic hammer will be ensured in spite of the oscillation-induced relative motion between the unit of construction and the operating cylinder, and the flexible connecting line will not restrict the freedom of movement of the operating cylinder, as is important for the damping action. The flexible connecting line may consist of hose pieces, elastically deformable tubular pieces, or elastically supported rigid pipe connectors or the like.

BRIEF DESCRIPTION OF THE DRAWING

The subject matter of the invention is illustrated by way of example in the drawing, in which.

DETAILED DESCRIPTION OF PREFERRED EMBODIMENTS

Figure 1:
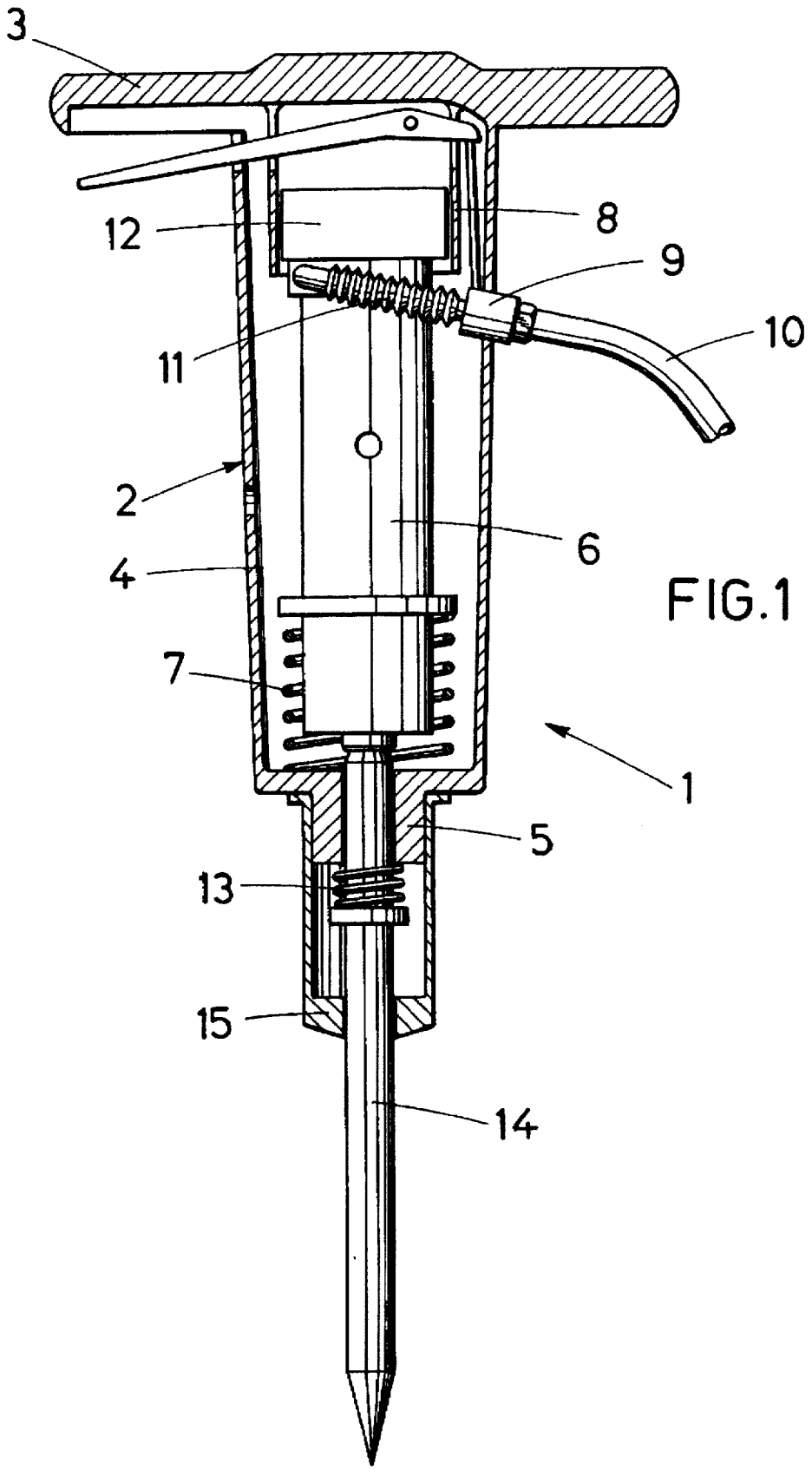
FIG. 1 is a schematic axial sectional view showing a pneumatic hammer in accordance with the invention and FIGS. 2 and 3 are, respectively, an axial sectional view taken on line II—II in FIG. 3 and a transverse sectional view taken on line III—III in FIG. 2 and show an illustrative embodiment of the design of such a pneumatic hammer adjacent to the tool holder.

A pneumatic hammer 1 comprises a rigid unit of construction 2, which is composed of a handle 3, a housing 4, and a tool holder 5. Operating cylinder 6 is resiliently supported in housing 4 by supporting spring 7 adjacent to the tool holder 5 and adjacent to the handle 3 is axially movably guided by a longitudinal guide 8. Compressed air is supplied to the operating cylinder 6 from compressed air line through port 9 mounted in the wall of the unit of construction 2. A turn-on valve is arranged in the tubular port. A flexible connecting line 11 extends from the tubular port to a distributor 12 of the operating cylinder 6. As a result, the supply of compressed air to the operating cylinder 6 is ensured whereas the operating cylinder 6 can oscillate within the unit of construction 2.

Damping means 13 act on tool holders opposite to the striking direction and will damp rebound forces exerted by a tool 14, inserted into the tool holder 5. The tool holder 5 is closed on the tool side by a tool-catching device 15, which may serve as an additional handle.

Figure 2:
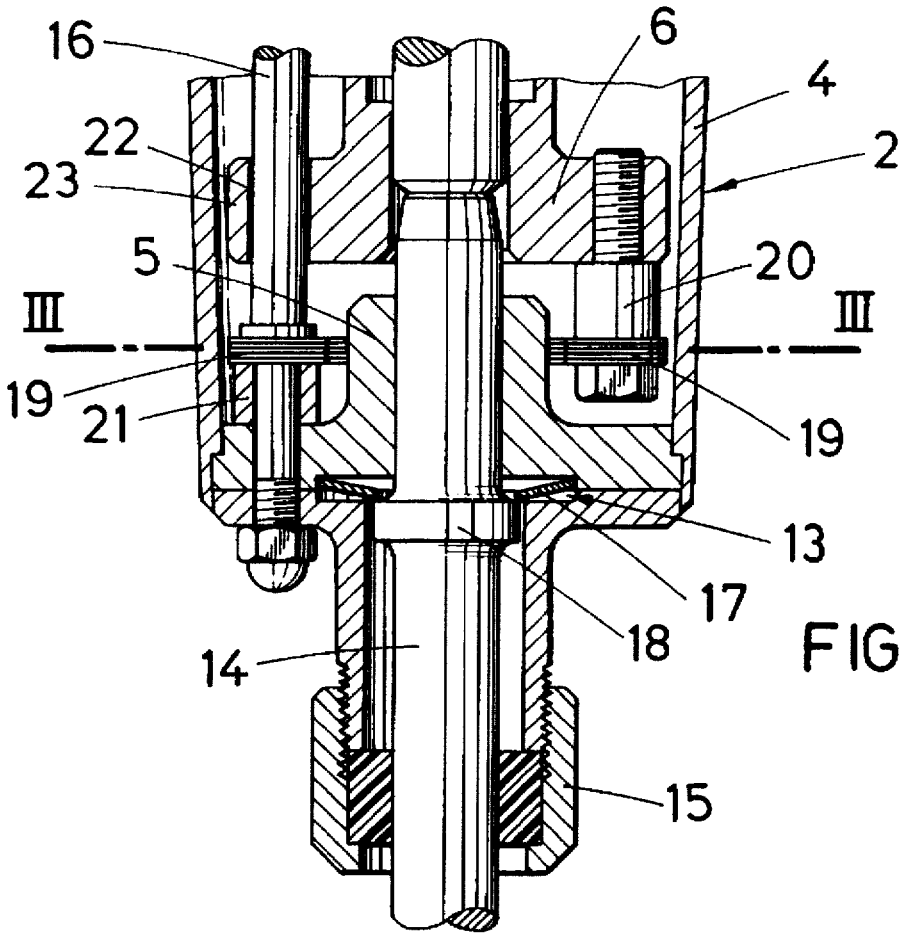
Figure 3:
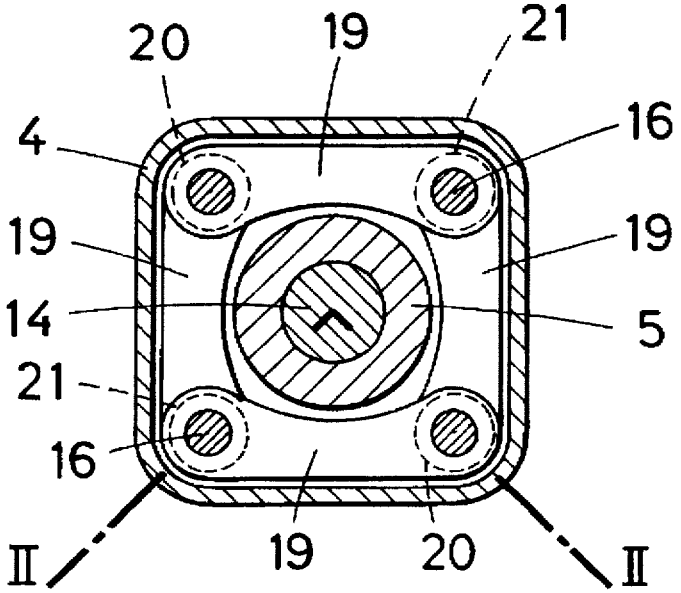

As is indicated in the illustrate embodiment shown in FIGS. 2 and 3, the housing 4, the handle, which is not shown in more detail, and the tool holder 5 are clamped together by tie rods 16 so that the unit of construction 4 can economically be assembled from prefabricated individual parts. The damping means 13 for t he tool holder 5 consists of a disk spring 17, which cooperates with the flange 18 of a tool 14 and readily will effect a damping of impacts with a hard spring characteristic.

The operating cylinder 6 is supported by transverse leaf springs 19, which by means of spacers 20, 21 are supported at one end on the operating cylinder 6 and at the other end on the tool holder 5. The leaf springs 19 desirably engage the tie rods 16. The tie rods 16 extend through guide bores 22 of a cylinder flange 23 to serve also as guide rods for the operating cylinder.

Owing to the provision of the rigid unit of construction 2, a stiff is connection between the tool holder 5 and the handle 3 provided, which permits an effective guidance of the tool 14 and of the entire pneumatic hammer. That guidance will not be adversely effected by the support of the working cylinder 6, which is resiliently supported in housing adjacent to the tool holder 5 so that the softness of the supporting spring 7, on the one hand, and the damping properties of the housing 4, which constitutes a sound absorber, will result in an excellent damping of vibration. The damping means 13 are intended merely to take up and damp the impacts which are due to rebounds during the use of the pneumatic tic hammer 1 and may be rather stiff so that they will not adversely affect the feeling of the operator for the tool. At the same time, the housing 4 will also intensify the damping action of damping means 13.

We claim:

1. A pneumatic hammer comprising (a) a rigid unit of construction composed of
  (1) a ho using having an axis,
  (2) a handle, and
  (3) a tool holder for receiving a tool movable in a striking direction, (b) an operating cylinder resiliently supported in the housing and axially movable in the housing relative to the tool holder for moving the tool in the striking direction, (c) a longitudinal guide for the axially movable operating cylinder, (d) means for resiliently supporting the operating cylinder adjacent the tool holder, (e) a damping means acting upon the tool holder in a direction opposite to the striking direction, and (f) means for supplying compressed air to the operating cylinder.

2. The pneumatic hammer of claim 1, wherein the means for resiliently supporting the operating cylinder are leaf springs extending transversely to the housing axis, further comprising spacers respectively connecting the leaf springs to the housing and the operating cylinder.

3. The pneumatic hammer of claim 2, further comprising tie rods extending axially between the handle and the tool holder for holding the rigid unit of construction together.

4. The pneumatic hammer of claim 3, wherein the tie rods constitute a longitudinal guide for the axially movable operating cylinder.

5. The pneumatic hammer of claim 1, wherein the means for supplying compressed air to the operating cylinder comprises a port in the housing, compressed air distributing means for controlling the compressed air supply to the operating cylinder, and a flexible line in the housing for connecting the port to the compressed air distributing means.

* * * * *

UNITED STATES PATENT AND TRADEMARK OFFICE

CERTIFICATE OF CORRECTION

PATENT NO. : 5,797,463

DATED : August 25, 1998

INVENTOR(S) : Udo Winter et al

It is certified that error appears in the above-indentified patent and that said Letters Patent is hereby corrected as shown below:

On the cover page, column 1, item [30], change "[AU] Australia" to --[AT] Austria --.

Signed and Sealed this

Ninth Day of March, 1999

*Attest:*

*Attesting Officer*

Q. TODD DICKINSON

*Acting Commissioner of Patents and Trademarks*